US007942415B2

(12) United States Patent
Hastings et al.

(10) Patent No.: US 7,942,415 B2
(45) Date of Patent: May 17, 2011

(54) MAIL SORTING MACHINE WITH IMPROVED DIVERTER PANEL

(75) Inventors: Kenneth S. Hastings, Grand Prairie, TX (US); John W. Sheffield, Forney, TX (US); John W. Ivey, Jr., Euless, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 105 days.

(21) Appl. No.: 12/410,499

(22) Filed: Mar. 25, 2009

(65) Prior Publication Data

US 2010/0007085 A1 Jan. 14, 2010

Related U.S. Application Data

(60) Provisional application No. 61/079,274, filed on Jul. 9, 2008.

(51) Int. Cl.
*B65H 39/10* (2006.01)

(52) U.S. Cl. ..... 271/289; 271/290; 271/298; 209/900

(58) Field of Classification Search ..... 271/289, 271/290, 298; 209/900
See application file for complete search history.

(56) References Cited

U.S. PATENT DOCUMENTS

| | | | | | |
|---|---|---|---|---|---|
| 3,709,492 | A * | 1/1973 | Baker et al. | ..... | 271/290 |
| 3,830,590 | A * | 8/1974 | Harris et al. | ..... | 399/364 |
| 3,845,949 | A * | 11/1974 | Acquaviva et al. | ..... | 271/290 |
| 3,870,295 | A * | 3/1975 | Kukucka | ..... | 271/290 |
| 4,043,625 | A | 8/1977 | Bleeker | | |
| 4,318,542 | A * | 3/1982 | Altmann et al. | ..... | 271/290 |
| 4,621,798 | A | 11/1986 | Akers | | |
| 5,109,987 | A | 5/1992 | Daboub et al. | | |
| 5,190,282 | A | 3/1993 | Rabindran et al. | | |
| 5,981,891 | A * | 11/1999 | Yamashita et al. | ..... | 209/584 |
| 6,026,967 | A * | 2/2000 | Isaacs et al. | ..... | 209/539 |
| 6,245,415 | B1 | 6/2001 | Keller et al. | | |
| 6,994,220 | B2 | 2/2006 | Schererz et al. | | |
| 2003/0226789 | A1 * | 12/2003 | Shiibashi et al. | ..... | 209/584 |
| 2007/0119757 | A1 * | 5/2007 | Svyatsky et al. | ..... | 209/584 |

* cited by examiner

*Primary Examiner* — David H Bollinger
(74) *Attorney, Agent, or Firm* — Filip A. Kowalewski

(57) ABSTRACT

A diverter panel comprises an elongated rectangular panel made of a substantially flat plate made of clear plastic. The plate has fasteners mounted at its front corners for mounting the panel to a frame of the sorting machine, a rear upright flange extending from the plate along the length thereof, the flange having a bottom edge which can be supported on a horizontal beam of the sorting machine. The panel is rigid enough such that vibration of the sorting machine does not cause significant movement of the panel when secured at its corners and with the rear flange supported by the beam of the sorting machine. An opening in the rear flange and an adjacent portion of the plate allows a drive shaft to pass therethrough, and a contact pad formed by an outwardly projecting portion of the rear flange is configured for engagement with a plunger of a switch.

7 Claims, 4 Drawing Sheets

SECTION A-A

SECTION B-B

SECTION A-A

MAIL SORTING MACHINE WITH IMPROVED DIVERTER PANEL

This application claims priority of U.S. provisional application No. 61/079,274 filed Jul. 9, 2008.

FIELD OF THE INVENTION

The invention relates to postal sorting machines as currently operated by the U.S. Postal Service (USPS).

BACKGROUND OF THE INVENTION

Daboub, et al. U.S. Pat. No. 5,109,987 May 5, 1992, incorporated by reference herein, describes a multilevel sorting machine of a type which is now in widespread use in various forms, with specific machines known as DBCS, MLOCR and more recently MLOCR with extended capability that can handle a wider range of mail piece sizes. It is well known in the art that such machines include a mail piece feeder, a transport section which transports a singulated stream of mail pieces from the feeder section on a pinch belt conveyor, and a stacker section which includes a row of stackers equipped with gates that are operated by the control system to divert a mail piece from the passing stream. The divert gates are operated on the basis of scanned address information gathered as the mail piece is entering the transport section from the feeder.

Daboub, et al. is one early example of a multi-level stacker section. The transport section includes a mechanism for routing mail pieces to one of two or more vertical levels on which a row of stacker pockets is located, each level having its own pinch belt transport. There are commonly rows of stacker pockets on both the front and back of the stacker section.

In the development of such multi-level sorters, it was found beneficial to provide shelves or horizontal diverter panels between levels on each side of the sorter. This is presently deemed an essential safety feature for such sorters. It prevents human workers from reaching up into the moving parts of the stacker section on the level above. The present invention relates to improvements in such panels.

SUMMARY OF THE INVENTION

A diverter panel of the invention is configured for horizontal installation between stacker levels of an automated mail sorting machine. It comprises an elongated rectangular panel made of a substantially flat plate made of clear plastic. The plate has fasteners mounted at its front corners for mounting the panel to a frame of the sorting machine, and a rear upright flange extending from the plate along the length thereof, the flange having a bottom edge which can be supported on a horizontal beam of the sorting machine. The panel is rigid enough such that vibration of the sorting machine does not cause significant movement of the panel when secured at its corners using the fasteners and with the rear flange supported by the beam of the sorting machine. An opening in the rear flange and an adjacent portion of the plate allows a drive shaft to pass through the panel, and a contact pad is configured for engagement with a plunger of an interlock switch, which pad is formed by an outwardly projecting portion of the rear flange. The pad and rigid nature of the panel prevents the plunger of the interlock switch from tripping the interlock switch. These and other aspects of the invention are described further in the detailed description that follows. It is to be understood that terms used in the present invention, such as "stackers", should be given their meanings recognized in the postal sorting art, if applicable, not more general definitions found in dictionaries.

BRIEF DESCRIPTION OF THE DRAWINGS

In the accompanying drawings, where like numerals denote like elements denote multiples of a component.

DETAILED DESCRIPTION

Figure 1:
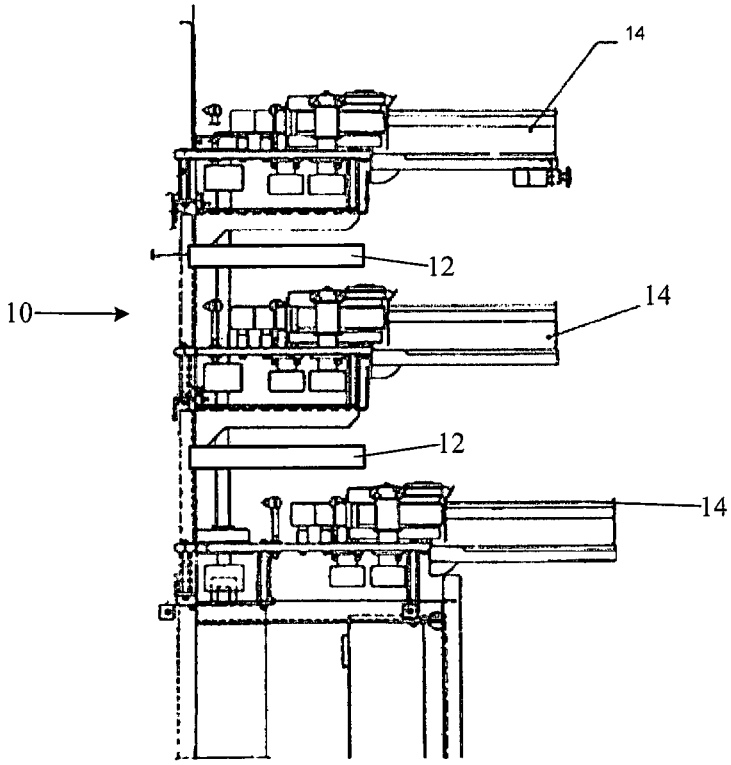
Fig. 1 PRIOR ART
FIG. 1 is a side view of a stacker section with diverter panels installed, applicable to the prior art "wimpy" panel and the panel of the invention.
Figure 2:
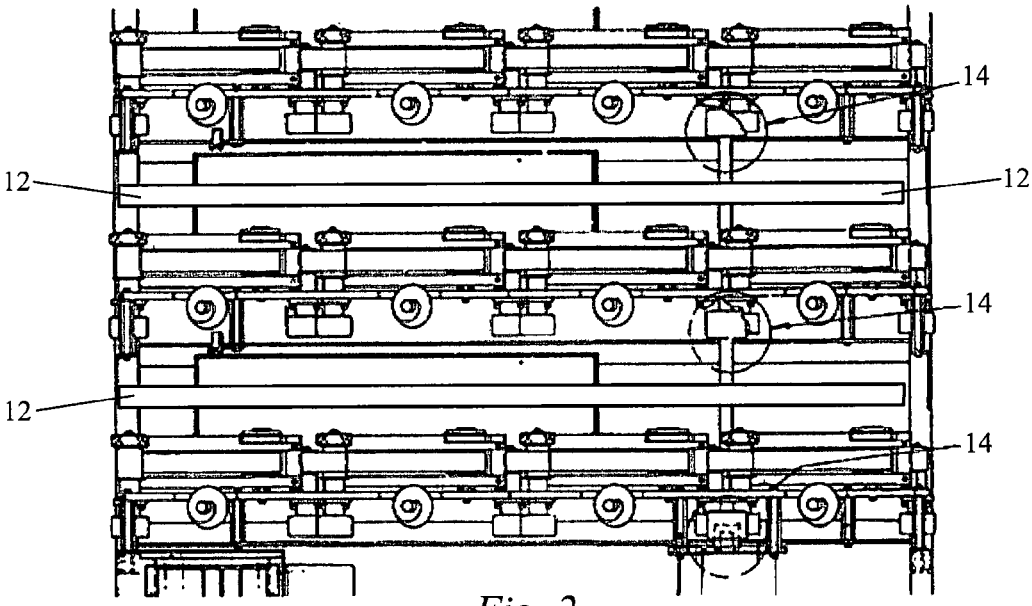
Fig. 2 PRIOR ART
FIG. 2 is a front view of the stacker section of FIG. 1.
Figure 3:
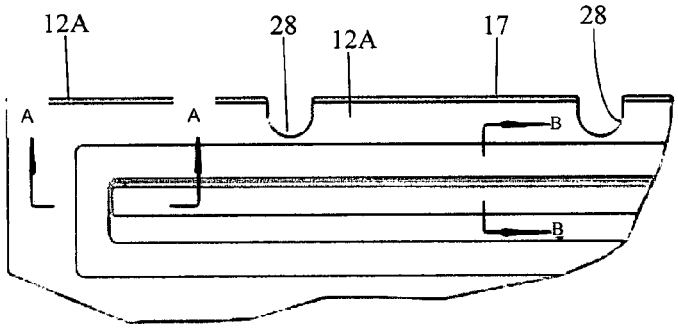
Fig. 3 PRIOR ART
FIG. 3 is a partial plan view of the prior art "wimpy" panel.
Figure 3A:
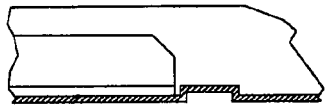
Fig. 3A PRIOR ART
FIG. 3A is taken along the line A-A in FIG. 3.
Figure 3B:
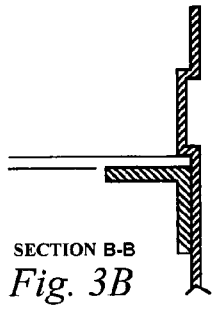
Fig. 3B PRIOR ART
FIG. 3B is taken along the line B-B in FIG. 3.

FIGS. 1 and 2 show the position of diverter panels 12 in a stacker section 10 of a postal letter sorting machine as shown. Panels 12 are located behind the individual stackers 14, above and below adjacent stackers, and are provided between levels other than above the top level and below the lowest level at which stackers 14 are located. A secondary function of panels 12 is to catch mail pieces that have fallen from the level above as occasionally happens due to a misfeed or failure to divert the mail piece into a stacker pocket. For this purpose it is beneficial to make the panels 12 of transparent plastic so that the operator can see a fallen mail piece to remove it. Each row of panels 12 comprises several panels end to end as needed to cover all of the stackers 14 on that side of the machine. It is common to provide stackers 14 on both the front and back of the stacker section 10, hence at each level between stackers a front and back row of diverter panels 12 is provided. Each individual panel 12 comprises a generally flat plate that is preferably between 4 and 5 feet long about 10 to 12 inches wide.

Figure 4A:
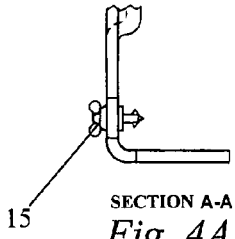
Fig. 4A PRIOR ART
FIG. 4A is taken along the line A-A in FIG. 4.
Figure 4:
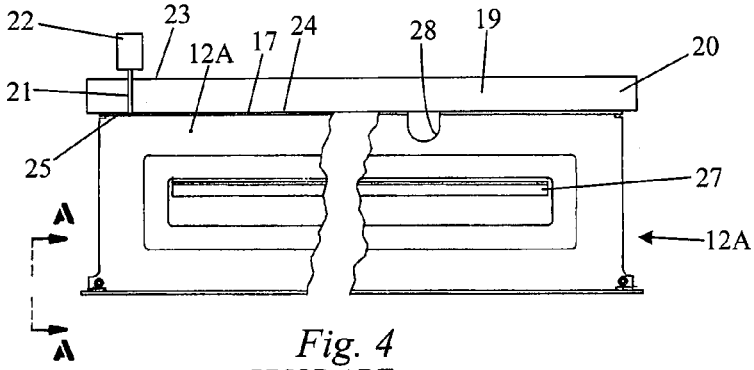
Fig. 4 PRIOR ART
FIG. 4 is a plan view of the panel of FIG. 3 showing the panel corners.

Panel 12 is mounted at its front corners by screws 15 to holes in vertical beams 16 forming part of the stacker frame. Its rear lengthwise edge is supported in an outwardly facing channel 19 in a horizontal I-beam 20 forming part of the stacker frame. A plunger 21 of the interlock switch 22 extends through a hole in an upper outwardly extending horizontal flange 23 of beam 20. The right angled rear edge 24 of the prior art panel 12A of FIG. 4 is interposed between the end of plunger 21 and a lower outwardly extending horizontal flange 25 of beam 20. Edge 24 often comes loose so that plunger 21 is not sufficiently depressed, and the interlock switch 22 opens and shuts down the machine. Wimpy panels 12A are opaque. Panel 12A in one form has a molded lengthwise reinforcement bar 27 which was, however, ineffective to strengthen the panel 12A in a useful way. Rear edge 24 also has a pair of rounded cutouts 28 which allow a drive shaft of the conveyor system to pass through. One cutout 28 corresponds to the position of the drive shaft for a panel mounted on the front of the machine, and the other to the position of drive shaft for a panel mounted on the rear side of the machine.

The form of diverter panels has varied from one model of sorting machine to the next, and it is known to employ a panel that is both transparent and substantially rigid. However, in the DBCS 990 line of letter sorting machines, the panels 12A used have been subject to frequent failure. One mode of failure is that the rear edge 24 comes loose from the interlock switch plunger 21 as described above. If a shutdown occurs, mail in transit on the conveyor at the time of shutdown has to be manually removed and re-sorted. The existing panel 12A also has a tendency to work itself completely loose and fall off, again causing interlock shutdown. The resilient, flexible nature of the plastic used to make the wimpy panel 12A causes it to vibrate more than it should despite use of a rectangular protrusion that forms a pair of ribs along a central portion of the panel running in its lengthwise direction, to which reinforcement 27 was later added to no avail.

Figure 5:
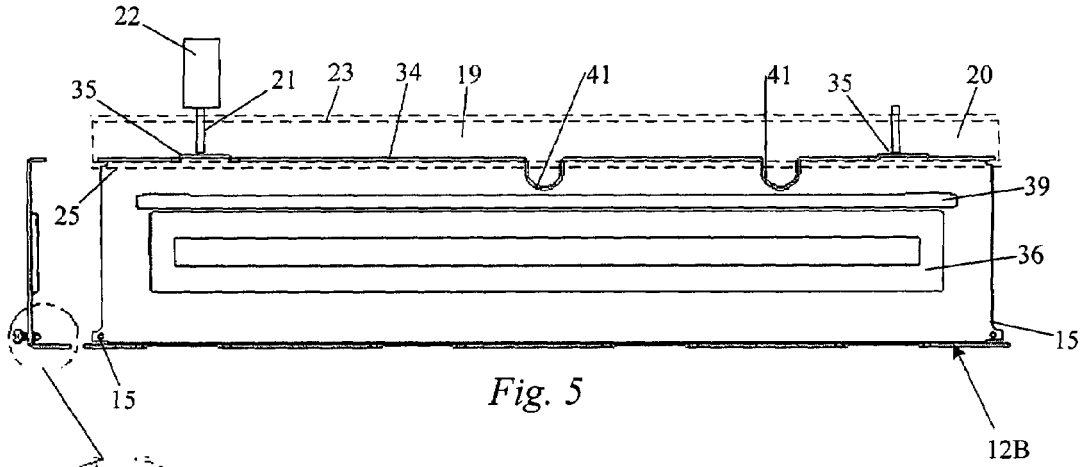
FIG. 5 is a plan view of a panel according to the invention.
Figure 5A:
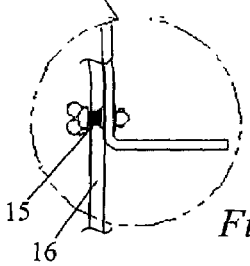
FIG. 5A is an enlarged view of the circled area in FIG. 5.
Figure 6:
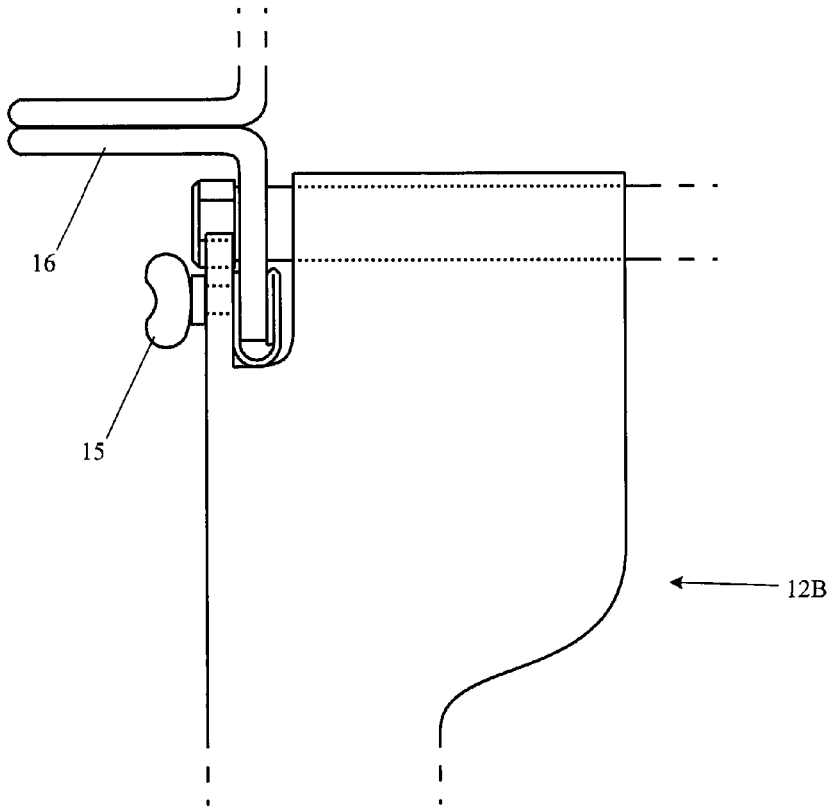
FIG. 6 is a perspective view of a panel of the invention mounted on a stacker frame.

Referring to FIGS. 5 and 6, a diverter panel 12B of the invention can be installed on the stacker section 10 in the same manner as described above for the wimpy panel 12A, but with certain key differences. The panel 12B is clear so that mail can be seen and made of polycarbonate that is thicker than the plastic used to make panel 12 (about ⅛ inch as opposed to 1/16" for panel 12A) and much more rigid. Rear edge 34, which corresponds to edge 24 of panel 12, has a pair of spaced projections 35 on its outer surface which correspond to the positions of the interlock switch 22 for use on either the front or back of the stacker section 10. Projections 35 contact the plunger 21 along a flat outer surface of the projection. Projections 35 are formed using outwardly directed segments of edge 34 forming corresponding notches on the inside of edge 34. The thickness of edge 34 is uniform and preferably the same as the main portion of the generally flat plate which comprises the main body of panel 12B is molded. Projections 35 provide a contact pad with larger, more secure engagement surface for plunger 21.

Figure 7:
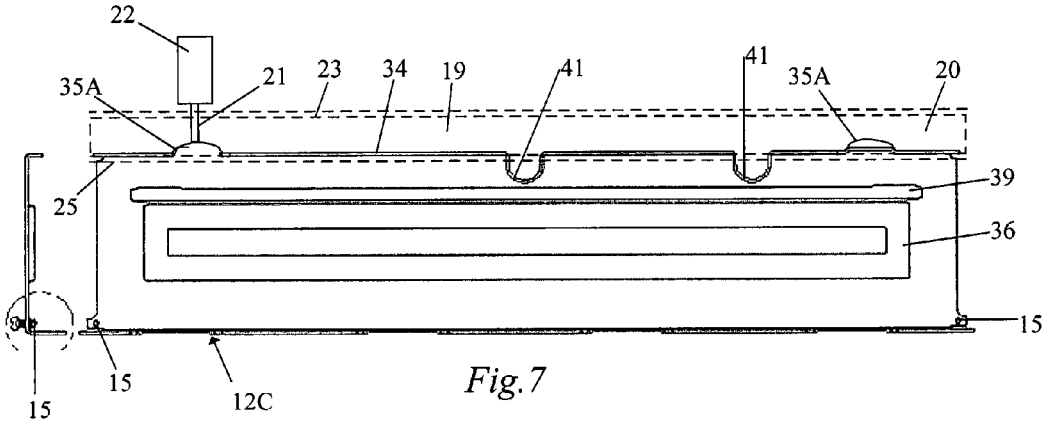
FIG. 7 shows a rounded contact pad according to the invention.

In the embodiment of a panel 12C of the invention shown in FIG. 7, projections 35A are provided that present a curved (concave) surface towards the end of plunger 21. This embodiment makes it easier to center the end of plunger 21 on the center (highest point) of the projection 35A, and also to remove panel 12C by releasing front corner fasteners 15 and then sliding the panel out allowing the end of plunger 21 to slide off of the top of projection 35A.

Panels 12B and 12C also have central lengthwise reinforcement ribs 36 which are thicker than those of the prior panel 12A, and an additional molded reinforcement bar 39 extending in a lengthwise direction between edge 34 and the rectangular figure formed by ribs 36. A reinforcement at this location has proven more effective at preventing unwanted movement of edge 34. Ribs 36 and bar 39 are formed in a manner similar to pads 35 and 35*a* as areas wherein the plastic of the plate is offset or bent outwardly forming a projection but has the same thickness as the rest of the plate. Rounded, vertically projecting walls 41 surrounding openings 28 provide additional stability, whereas panel 12A provides only a thin edge with no vertical extension at the same locations. Ribs 36, bar 39 and walls 41 all extend downwardly when the panel 12B or 12C is installed.

Although several embodiments of the present invention have been described in the foregoing detailed description and illustrated in the accompanying drawings, it will be understood by those skilled in the art that the invention is not limited to the embodiments disclosed but is capable of numerous rearrangements, substitutions and modifications without departing from the spirit of the invention. Such modifications are within the scope of the invention as expressed in the appended claims.

The invention claimed is:

1. A diverter panel configured for horizontal installation between stacker levels of an automated mail sorting machine, comprising:

an elongated rectangular panel in the form of a substantially flat plate made of clear plastic, the plate having;

fasteners mounted at its front corners for mounting the panel to a frame of the sorting machine;

a rear upright flange extending from the plate along the length thereof, the flange having a bottom edge which can be supported on a horizontal beam of the sorting machine;

wherein the panel has a rigidity such that vibration of the sorting machine does not cause movement sufficient to displace the panel when secured at its corners using the fasteners and with the rear flange supported by the beam of the sorting machine;

an opening in the rear flange and an adjacent portion of the plate for allowing a drive shaft to pass through the panel; and a contact pad configured for engagement with a plunger of an interlock switch, which pad is formed by an outwardly projecting edge portion of the rear flange.

2. The diverter panel of claim 1, wherein the contact pad has a length of at least one inch and presents a flat outer surface for contact with the plunger of the switch.

3. The diverter panel of claim 1, wherein the contact pad has a length of at least about one inch and presents an outwardly rounded outer surface for contact with the plunger of the switch.

4. The diverter panel of claim 1, wherein the plate has a size of at least 3 to 5 feet long and from 10 to 12 inches wide.

5. The diverter panel of claim 1, wherein the pad presents a flat outer surface.

6. The diverter panel of claim 1, wherein the pad presents an outwardly rounded outer surface.

7. An automated sorting machine, including a mail piece feeder, a transport section which transports a singulated stream of mail pieces on a pinch belt conveyor, and a stacker section which receives the stream and diverts mail pieces from the stream into vertically spaced rows of stackers supported on a frame;

elongated rectangular horizontal diverter panels disposed between vertically spaced rows of stackers, each panel in the form of a substantially flat plate made of clear plastic, the plate having:

fasteners mounted at its front corners for mounting the panel to a frame of the sorting machine;

a rear upright flange extending from the plate along the length thereof, the flange having a bottom edge which can be supported on a horizontal beam of the sorting machine;

wherein the panel has a rigidity such that vibration of the sorting machine does not cause movement sufficient to displace the panel when secured at its corners using the fasteners and with the rear flange supported by the beam of the sorting machine;

an opening in the rear flange and an adjacent portion of the plate for allowing a drive shaft to pass through the panel; and a contact pad configured for engagement with a plunger of an interlock switch which shuts down the sorting machine if tripped, which pad is formed by an outwardly projecting edge portion of the rear flange.

* * * * *